US005359741A

United States Patent [19]

Lang

[11] Patent Number: 5,359,741

[45] Date of Patent: Nov. 1, 1994

[54] ROTATABLE AND REMOVABLE BED TRAY

[76] Inventor: Brian Lang, 39 Greenwood Trail, Brantford, Ontario, N3R 6G4, Canada

[21] Appl. No.: 49,373

[22] Filed: Apr. 21, 1993

[51] Int. Cl.[5] ..... A47B 23/02

[52] U.S. Cl. ..... 5/507.1; 108/49; 108/140; 248/415; 248/425

[58] Field of Search ..... 5/507.1, 503.1, 658, 5/623; 108/49, 140; 248/415, 425

[56] References Cited

U.S. PATENT DOCUMENTS

| | | | |
|---|---|---|---|
| 1,217,676 | 2/1917 | Wilson | 5/507.1 |
| 1,331,879 | 2/1920 | Shilling . | |
| 1,758,693 | 5/1930 | France | 5/507.1 |
| 2,193,647 | 3/1940 | Rush et al. | 5/507.1 |
| 2,664,147 | 12/1953 | O'Keefe | 297/172 |
| 2,946,638 | 7/1960 | Colo | 108/143 |
| 3,037,214 | 6/1962 | Staiger | 5/507.1 |
| 3,046,072 | 7/1962 | Douglass | 5/646 |
| 3,054,122 | 9/1902 | Sarkus | 108/49 |
| 3,400,829 | 9/1968 | Youngson | 5/507.1 |
| 4,431,154 | 2/1984 | Hamm | 5/503.1 |
| 4,504,992 | 3/1985 | Herron | 5/507.1 |

*Primary Examiner*—Alexander Grosz
*Attorney, Agent, or Firm*—Dowell & Dowell

[57] ABSTRACT

A rotatable and removable bed tray for institutional or private home use. The bed tray is easily adjustable by the bedridden patient or by others. Further, there is provided bed rail adaptor for adopting beds without bed rails to use the bed tray.

19 Claims, 4 Drawing Sheets

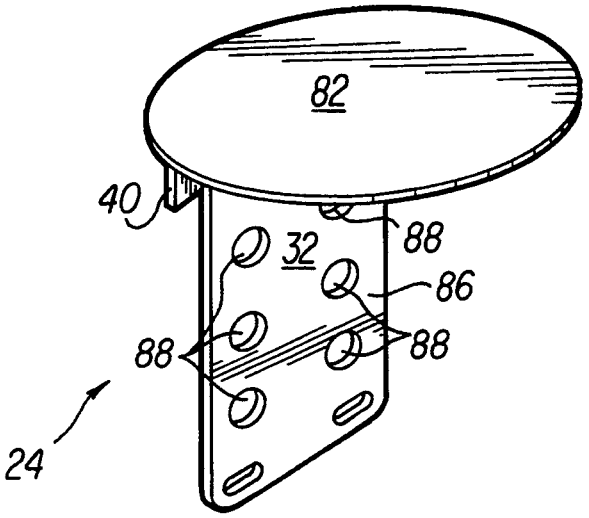
FIG. 4
FIG. 5
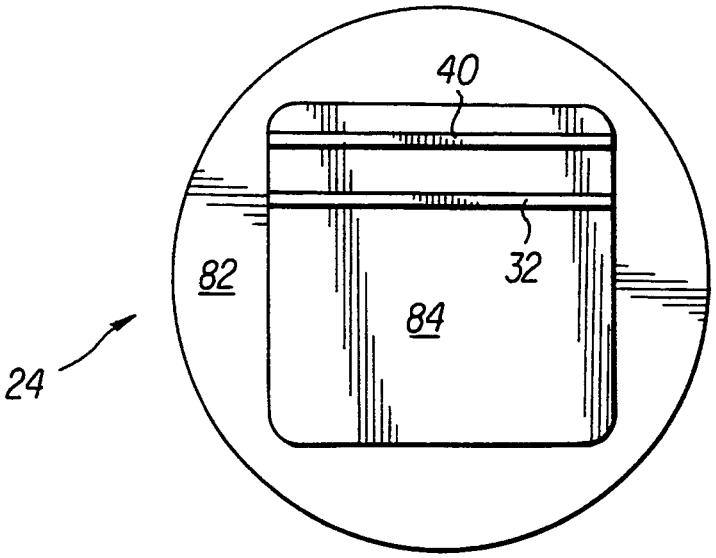
FIG. 6
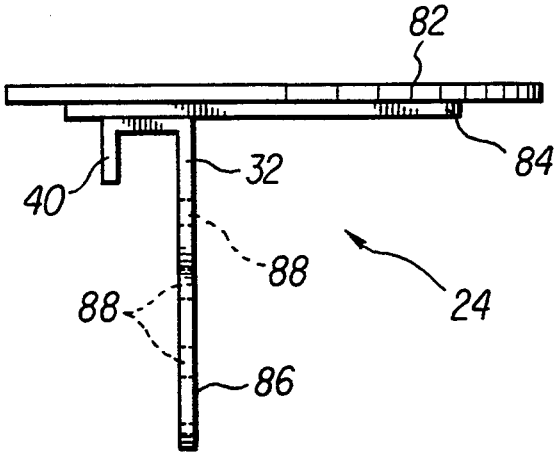

ROTATABLE AND REMOVABLE BED TRAY

FIELD OF THE INVENTION

This invention relates to a rotatable and removable bed tray.

BACKGROUND OF THE INVENTION

In hospitals, convalescent centres, private homes and the like, bedridden patients often require special apparatuses to adapt bed trays for convenient placement in relation to the patient to provide a surface upon which the patient may eat, read, etc.

Hospitals, the most common place for such bed trays, often use bed trays which are attached to a metal frame having wheels for locating a tray in front of a patient. A problem with such movable bed tray apparatuses is that these trays may be easily displaced or rolled from a position relative to the patient causing an inconvenience for the patient while eating and a further inconvenience to the care-giver who must relocate the tray. Further, such a bed tray assembly is expensive to fabricate and therefore presents a drain on a hospital budget and is likely too costly for use in private homes.

Other accessory tables for attachment to beds or hospital operating tables require special rails attached to an operating table to which an accessory table is secured to the operating table. There would be significant expense associated with adapting beds to include these special rails or attaching similar rails to a bed frame to adapt it for use with such accessory tables. Further, such an accessory table is not designed to facilitate the easy adjustment or removal of the table by the patient, but is rather configured to be firmly secured to an operating table frame to prevent movement of the accessory table while it is in use. Additionally, the elaborate brackets used to secure such accessory table to the operating table further increase the costs of the apparatus.

Less complicated tray attachments for patient beds have been designed for engagement with the side rails of a bed equipped with side rails. However, the manner of attachment of such trays to the side rails does not permit the simple adjustment of the bed tray by the patient and does not permit the easy removal of the tray. Further, not all beds for which a tray is required is equipped with side rails.

Others describe holders attached to bed side rails for holding telephones, patient communicators, and the like, but do not describe a bed tray assembly which may be adjusted by the patient or removed from the bed side rail. Further, such holders are not readily adapted for use with the beds which are commonly found in private homes, not equipped with side rails.

It is an object of the present invention to provide a bed tray apparatus which may be easily adjusted or rotated by a bedridden patient and easily removed from a bed.

It is a further object of the present invention to provide a bed tray apparatus which is simple and economical to produce.

It is yet another object of the present invention to provide a bed tray apparatus which may be adapted for use with beds commonly found in private homes.

STATEMENT OF THE INVENTION

According to an aspect of the present invention there is provided a bed tray assembly comprising a disk-shaped base plate with a central axis having side rail engagement means for removably engaging a bed side rail with the base plate held horizontally; a tray with a lower surface having base plate engagement means on its lower surface for removably and slidably engaging the base plate; wherein the tray, when engaging the base plate with the base plate engagement means, may be rotated about the central axis of the base plate.

According to a further aspect of the present invention, there is provided a bed tray assembly comprising a disk-shaped base plate with a central axis having side rail engagement means for removably engaging a bed side rail with the base plate held horizontally; a tray with a lower surface having base plate engagement means on its lower surface for removably and slidably engaging the base plate; wherein the tray, when engaging the base plate with the base plate engagement means, may be rotated about the central axis of the base plate; a sturdy base means for removably engaging a bed having a mattress or a frame; and a bed side rail adapter to removably and securably engage the base means, wherein the bed side rail adapter, when engaging the base means engaging a bed, is the bed side rail which the base plate removably engages with the side rail engagement means.

BRIEF DESCRIPTION OF THE DRAWINGS

The invention will be more clearly understood after reference to the following detailed description read in conjunction with the drawings which disclose example embodiments of the invention, wherein.

FIG. 4 is a perspective of disk-shaped base plate, to which a bed tray may be mounted in accordance with the present invention, adapted to attach to a bed side rail or side rail adapter;

FIG. 5 is a bottom plan view of the disk-shaped base plate of FIG. 4;

FIG. 6 is an elevational side view of the disk-shaped base plate of FIG. 4;

DETAILED DESCRIPTION OF THE PREFERRED AND ALTERNATIVE EMBODIMENTS

Figure 1:
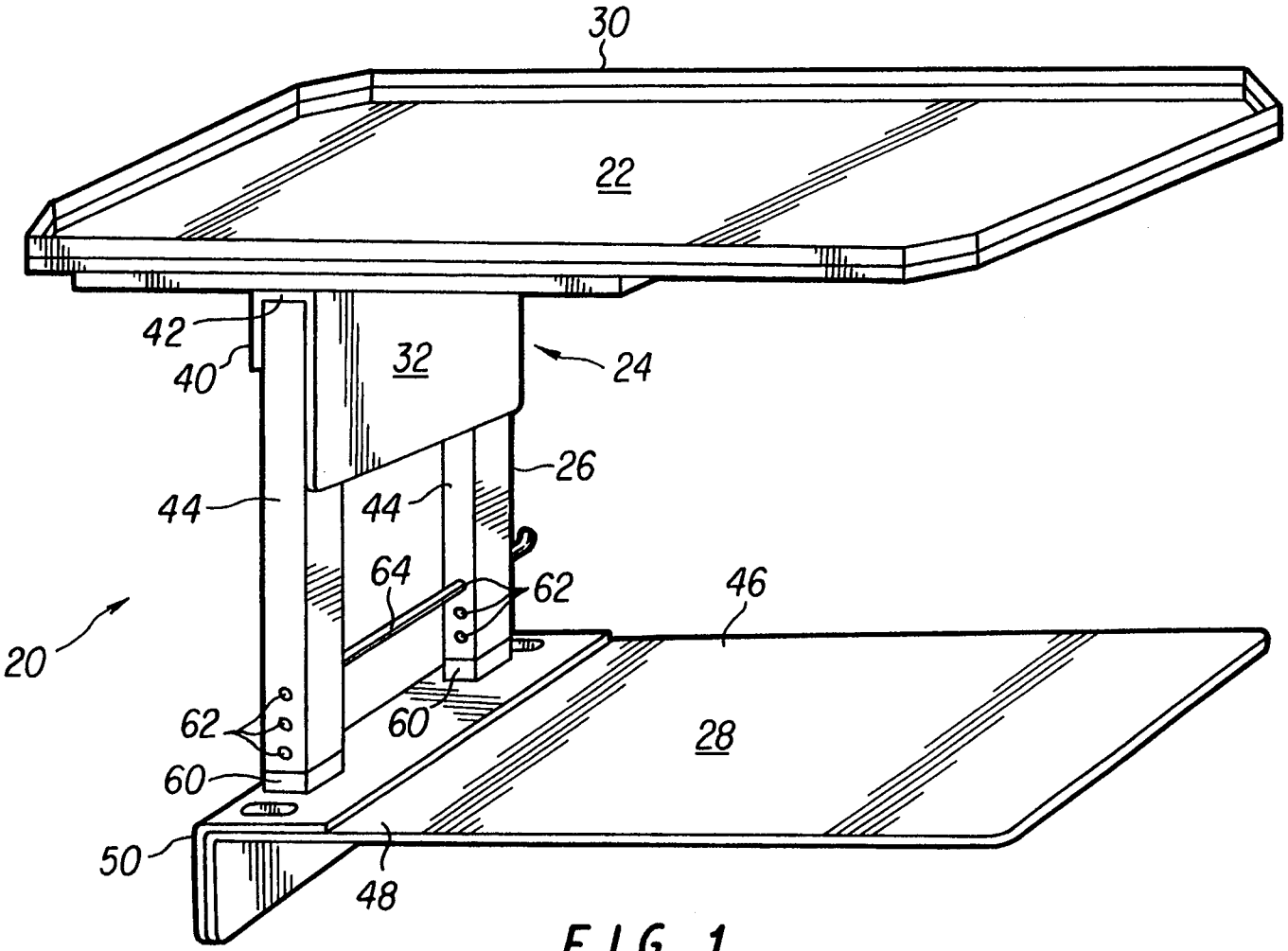
FIG. 1 is a perspective view of a bed tray mounted upon a side rail adapter which is attached to an under-mattress base member in accordance with an embodiment of the present invention.

With reference to FIG. 1 of the drawings, the reference numeral 20 refers generally to a rotatable and removable bed tray assembly constructed in accordance with an embodiment of the present invention. The bed tray assembly 20 includes a tray 22 pivotally and slidably connected to a base plate assembly shown generally at 24, which is removably mounted upon a bed side rail adapter 26 which is attached to an under-mattress base plate 28. Tray 22 may include a raised side edge 30 about its outer edge for containing liquids spilled upon the surface of tray 22. Base plate assembly 24 includes two parallel spaced plates, inner plate 32 and outer plate 40, which slidably receive therebetween horizontal top rail 42 and parallel vertical hollow tubes 44 of bed side rail adapter 26. Once mounted upon bed side rail adapter 26, base plate assembly 24 may be fixed in position by any suitable securing means, which may include bolts or other securing means. Alternatively, base plate assembly 24 may be fixed in its mounted position upon bed side rail adapter 26 using a friction fit. Under-mattress base member 28 includes a flat plate 46 which may include at outer end 48, a curved shoulder portion 50 to protect a person passing by from the sharp edges of flat plate 46 when base member 28 is in position under a mattress (not shown) . Depending from curved shoulder portion 50 are a pair of upstanding tubes 60 which are spaced and dimensioned to be slidably received within hollow vertical tubes 44 of bed side rail adapter 26 to secure bed side rail adapter 26 to base member 28. To permit vertical adjustment of bed side rail adapter 26, and therefore bed tray 22, with respect to flat plate 46, a series of spaced apertures 62 are provided through tubes 44 and corresponding apertures (not shown) through tubes 60 in a manner such that a securing rod 64 may be inserted through any set of apertures 62 aligned with apertures in tubes 60, to secure bed side rail adapter 26 to under-mattress base member 28.

Figure 2:
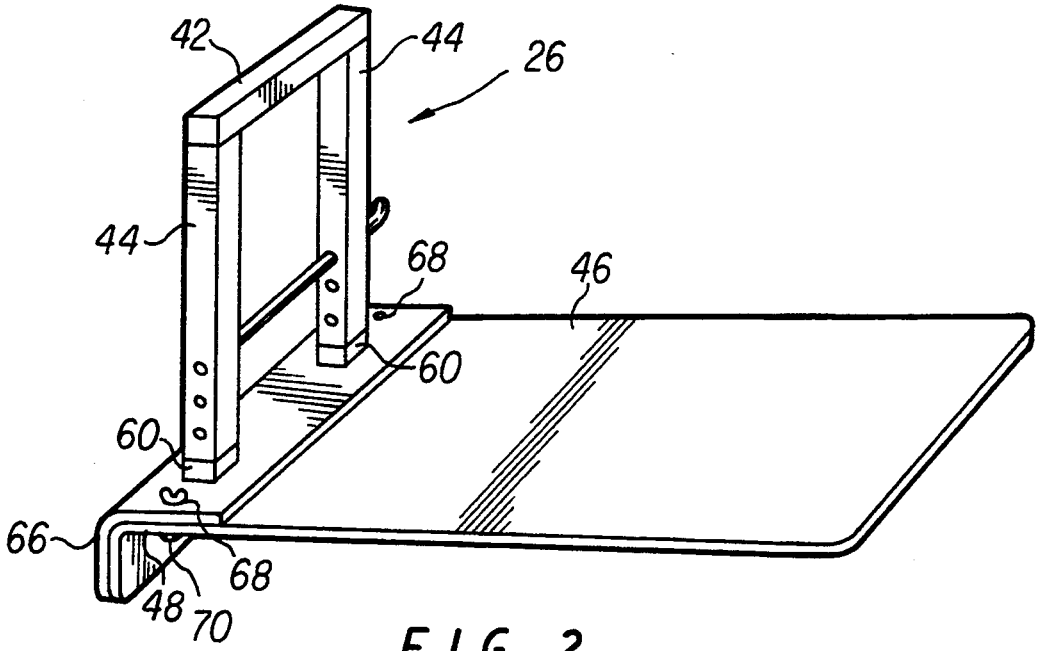
FIG. 2 is a perspective view of a bed side rail adapter attached to an under-mattress base member.
Figure 3:
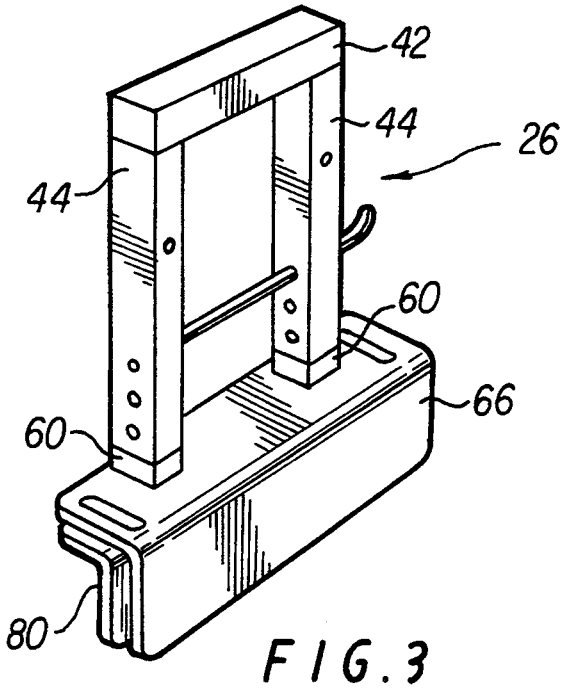
FIG. 3 is a perspective view of a bed side rail adapter mounted to a bed rail attachment bed member.

With reference to FIGS. 2 and 3 of the drawings, two configurations of bed side rail adapter 26 are shown with base plate assembly 24 removed. Various configurations of bed side rail adapter 26 are conveniently used where a bed is not equipped with side rails.

Referring first to FIG. 2, horizontal top rail 42 is more clearly shown in relation to parallel vertical hollow tubes 44. Horizontal top rail 42 is permanently attached at its ends to parallel vertical hollow tubes 44. Rail 42 and tubes 44 are shown to be constructed from square hollow steel tubing. As will be obvious to a person skilled in the art, any easily cleaned, durable material of construction may be substituted. The illustrated embodiment is constructed of 1" hollow square steel tubing, coated with an epoxy enamel. Other suitable materials may include stainless steel, aluminum or a durable plastic material to mention a few. Upstanding tubes 60 are shown to be constructed of square tubing of an external diameter which may be received within the hollow cavity of tubes 44. As with tubes 44, upstanding tubes 60 are constructed from epoxy enamel coated steel tubing. In the illustrated embodiment, upstanding tubes 60 are constructed from ¾ hollow square steel tubing for ease of insertion within parallel vertical tubes 44. Tubes 60 are secured to curved plate 66, preferably by spot welding. Curved plate 66 is adapted to overlay the outer end 48 of flat plate 46 which, in the illustrated embodiment, is also curved, and is suitably configured to be secured thereto. In the illustrated embodiment, locating holes 68 are drilled through both curved plate 66 and outer end 48 of flat plate 46 and bolts 70 are inserted therethrough and secured. The assembly of FIG. 2 is for use on beds not having a bed side rail and where it is not desired to attach the adapter to the frame of a bed. This configuration of adapter provides a side rail assembly 26 upon which the base plate assembly 24 may be mounted. This allows for the use of the invention in private homes on beds not normally equipped with bed side rails. Flat plate 46 is inserted beneath a mattress (not shown) to provide support to upstanding tubes 60 which extend upwardly at the side edge of the mattress to support the entire assembly from tilting.

An alternate manner of securing bed side rail adapter 26 to a bed is shown in FIG. 3. The relation and description of rail 42, tubes 44, upstanding tubes 60 and curved plate 66 are as described in relation to FIG. 2. Rather than a flat plate 46 for insertion beneath a mattress (not shown), curved plate 80 is adapted to engage a standard angle iron frame of a bed (not shown). The bed side rail adapter of FIG. 3 may be used where it is preferred to attach the bed side rail adapter to the standard frame of the bed, rather than supporting the bed side rail adapter by a flat plate located underneath a mattress. Such a configuration of the bed side rail adapter would be suitable where the expense associated with the flat plate is preferably eliminated, for example.

With reference to FIGS. 4, 5 and 6 base plate assembly 24 includes a flat circular disk 82 attached to a strengthening support plate 84, which is in turn attached to bed side rail mounting adapter 86. Adapter 86 includes inner and outer parallel plates 32 and 40. In the illustrated embodiment, inner and outer parallel plates 32 and 40 are formed from single metal plate bent into a rectangular "J" shape. It is apparent that inner and outer plates 32 and 40 may be fashioned from separate metal plates. As with the previously described components, flat circular disk 82 and inner and outer plates 32 and 40, as well as support plate 84, are preferably constructed often easily cleaned and durable material. The illustrated embodiment is constructed of epoxy enamel coated steel, however, other suitable materials such as stainless steel, aluminum or plastic may be substituted. Inner plate 40 may include a series of apertures 88 which may be used to secure base plate assembly 24 to a bed side rail (not shown). It is preferred that the spacing of plates 32 and 40 is such that a snug fit about a bed side rail (not shown) is achieved. Such a fit would permit the use of the tray without the need for means to secure the base plate assembly 24 to the side rail. In the illustrated embodiment, a clearance in the range of several thousandths of an inch in total is provided between plates 32 and 40 and the hollow tubing from which the bed side rail is constructed.

Figure 7:
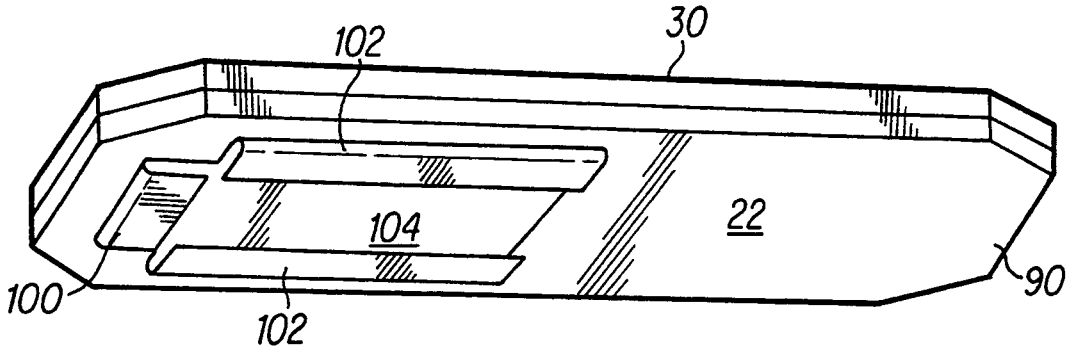
FIG. 7 is a perspective bottom side view of a tray in accordance with the present invention which is adapted to be mounted upon the disk-shaped base plate of FIG. 4.
Figure 8:
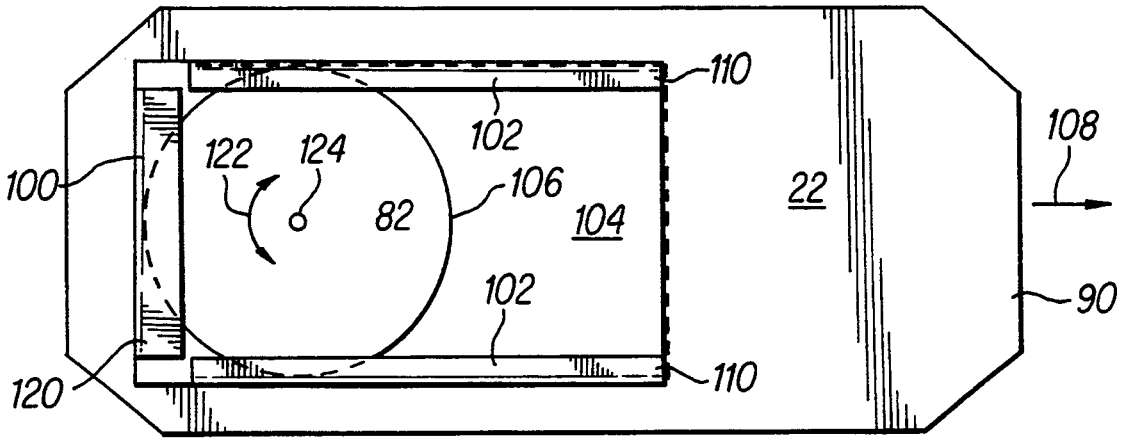
FIG. 8 is a bottom plan view of the tray of FIG. 7 mounted rotatably and removably to a disk-shaped base plate in accordance with an embodiment of the present invention.

With reference to FIGS. 7 and 8 of the drawings, bed tray 22 is shown as viewed from the bottom to better depict the manner in which tray 22 is secured to flat circular disk 82 of base plate assembly 24 (not shown). Mounted to the bottom surface 90 of tray 22 is base plate assembly mounting adapter 100. Adapter 100 is shown to comprise two parallel longitudinal side flanges 102 which are generally "L" shaped and which depend from the bottom of tray 22. The free end of the flange is spaced from the metal plate 104 from which they are fashioned to receivably and slidably engage the outer edge 106 of flat circular disk 82. Disk 82 may be engaged by tray 22 by sliding tray 22 in the direction shown by arrow 108 to initially engage the open ends 110 of flanges 102, and then moved in the direction of arrow 108 until the outer edge 106 of flat circular disk 82 is engaged by end flange 120. Flange 120 serves to prevent the further motion of tray 22 in the direction of arrow 108. By engaging flat disk 82 in this manner, tray 22 may be rotated in the directions shown by arrow 122 about the central axis 124 of circular disk 82, and may be removed from flat disk 82 by sliding tray 22 in a direction opposite to that shown by arrow 108.

The advantages of the presently described embodiment are several. The tray 22 and base plate assembly 24 may be used independently of the bedside rail adapter assembly 28 where a bed is equipped with standard bed side rails. In private homes, or where bed side rails are not usually provided, the base members such as those disclosed herein may be used to mount a bed side rail adapter to a standard bed, providing a base upon which may be mounted the base plate assembly. The entire bed tray apparatus is constructed of simple materials which may be easily obtained. Further, the cost of the entire assembly is low when compared to bed tray assemblies used traditionally. Finally, the simple pivot attachment between tray and base plate allows for easy rotating of the tray by the patient when they tray is not in use.

Other modifications and advantages of the presently described invention will be apparent to those skilled in the art and, therefore, the invention is defined in the claims.

I claim:

1. A bed tray assembly comprising:

a) a disk-shaped base plate having an upper face, a lower face and side rail engagement means for removably engaging a bed side rail and maintaining the base plate in a horizontal orientation; and b) a tray having a lower surface and base plate engagement means disposed on said lower surface for slidably and rotatably engaging the base plate, said base plate engagement means comprising first and second opposed substantially L-shaped flanges depending from the lower surface and projecting towards one another, and said tray being removable from the base plate.

2. The bed tray assembly of claim 1 further comprising:

c) a base means for removably engaging a bed; and d) a side bed rail adapter means to removably and securely engage the base means and the side rail engagement means.

3. The bed tray assembly of claim 2 wherein the base means comprises a flat portion for insertion between a mattress and a mattress support of a bed to prevent movement of the base means relative to the bed.

4. The bed tray assembly of claim 2 wherein the base means comprises a clamping means for attachment to a frame of a bed.

5. The bed tray assembly of claim 4 wherein the clamping means comprises a pair of curved surfaces for removably engaging a bed frame therebetween.

6. The bed tray assembly of claim 2 wherein the bed side rail adapter comprises two parallel hollow tubes depending downwardly therefrom and the base means comprises two parallel upstanding tubes, the hollow tubes being sized to removably receive the upstanding tubes.

7. The bed tray assembly of claim 6 wherein the base means is fixedly secured to the upstanding tubes.

8. The bed tray assembly of claim 7 wherein the hollow tubes each define a plurality of vertically spaced first apertures and the upstanding tubes each define a plurality of vertically spaced second apertures, each first aperture in one hollow tube being horizontally aligned with a first aperture in the other hollow tube and each second aperture in one upstanding tube being horizontally aligned with a second aperture in the other upstanding tube, a locking pin being simultaneously receivable in a selected pair of first apertures and a selected pair of second apertures to fixedly secure the tray in a selected vertical position relative to the base means.

9. The bed tray assembly of claim 1 wherein the side rail engagement means comprises two parallel plates depending from the lower face of the disk-shaped base plate and being spaced to slidably receive a bed side rail therebetween.

10. The bed tray assembly of claim 9 wherein the first and second opposed L-shaped flanges are spaced from the lower surface such that the base plate is slidably and rotatably receivable by the first and second flanges.

11. The bed tray assembly of claim 10 wherein the base plate engagement means further comprises a third L-shaped flange depending from the lower surface of the tray between and normal to the first and second flanges, the third flange projecting in a first direction toward the first and second flanges and being spaced from the lower surface, the base plate being engageable by the third flange to prevent further sliding of the tray in a second direction opposite said first direction.

12. The bed tray assembly of claim 1 wherein the first and second L-shaped flanges are spaced from the lower surface such that the base plate is slidably and rotatably receivable by the first and second flanges.

13. The bed tray assembly of claim 12 wherein the base plate engagement means further comprises a third L-shaped flange depending from the lower surface of the tray between and normal to the first and second flanges, the third flange projecting in a first direction toward the first and second flanges and being spaced from the lower surface, the base plate being engageable by the third flange to prevent further sliding of the tray in a second direction opposite to said first direction.

14. A bed tray assembly comprising:

a) a disk-shaped base plate having an upper face and a lower face b) bed engagement means connected to the base plate for engaging a bed and maintaining the base plate in a horizontal orientation; and c) a tray having a lower surface and base plate engagement means disposed on said lower surface for slidably and rotatably engaging the base plate, said base plate engagement means comprising first and second opposed substantially L-shaped flanges depending from the lower surface and projecting towards one another, and said tray being removable from the base plate.

15. The bed tray assembly of claim 14 wherein the bed engagement means comprises side rail engagement means for removably engaging a side rail of a bed.

16. The bed tray assembly of claim 15 wherein the side rail engagement means comprises two parallel plates depending from the lower face of the disk-shaped base plate, the parallel plates being spaced to slidably receive a bed side rail therebetween.

17. The bed tray assembly of claim 14 wherein the first and second opposed L-shaped flanges are spaced from the lower surface such that the base plate is slidably and rotatably receivable by the first and second flanges.

18. The bed tray assembly of claim 17 wherein the base plate engagement means further comprises a third L-shaped flange depending from the lower surface of the tray between and normal to the first and second flanges, the third flange projecting in a first direction toward the first and second flanges and being spaced from the lower surface, the base plate being engageable by the third flange to prevent further sliding of the tray in a second direction opposite to said first direction.

19. A bed tray assembly comprising:

a) a disk-shaped base plate having an upper face, a lower face and side rail engagement means for removably engaging a bed side rail and maintaining the base plate in a horizontal orientation; and b) a tray having a lower surface and base plate engagement means disposed on said lower surface for slidably and rotatably engaging the base plate, said base plate engagement means comprising first and second flanges depending from the lower surface and defining opposed elongated channels opening towards one another, and said tray being removable from said base plate.

* * * * *